United States Patent [19]

Emigh et al.

[11] Patent Number: 5,076,058

[45] Date of Patent: Dec. 31, 1991

[54] HEAT TRANSFER HEAD FOR A STIRLING CYCLE MACHINE

[75] Inventors: Stuart G. Emigh, Richland; Jack E. Noble, Darrington; Gregory A. Lehmann, Richland, all of Wash.

[73] Assignee: Stirling Technology Company, Richland, Wash.

[21] Appl. No.: 559,181

[22] Filed: Jul. 27, 1990

[51] Int. Cl.[5] ..... F02G 1/044

[52] U.S. Cl. ..... 60/525

[58] Field of Search ..... 60/525

[56] References Cited

U.S. PATENT DOCUMENTS 4,671,064 6/1987 White et al. ..... 60/517

FOREIGN PATENT DOCUMENTS 523269 4/1954 Belgium ..... 60/525

OTHER PUBLICATIONS

"Free Piston Stirling Engines-Some Model Tests and Simulations", by Beale, Society of Automotive Engineers, 1969 (Paper No. 690230).

"Conceptual Designs and Integration of Stirling Engines in Space Power Systems", by Darooka, IECEC, 1988 (Paper No. 889002).

"Development of a High Frequency Stirling Engine--Powered 3kW(e) Generator Set", by Lane et al., IECEC, 1989 (Paper No. 899156).

*Primary Examiner*—Allen M. Ostrager

*Attorney, Agent, or Firm*—Wells, St. John & Roberts

[57] ABSTRACT

A common heat acceptor is provided between opposed displacers in a Stirling cycle machine. It includes two sets of open channels in separate fluid communications with the expansion spaces of the receptive cyclinders. The channels confine movement of working fluid in separate paths that extend between the expansion space of one cylinder and the compression space of the other. The method for operating the machine involves alternatively directing working fluid from the expansion space of each cylinder in a fluid path leading to the compression space of the other cylinder and from the compression space of each cylinder in a fluid path leading to the expansion space of the other cylinder.

9 Claims, 8 Drawing Sheets

HEAT TRANSFER HEAD FOR A STIRLING CYCLE MACHINE

The Government has rights in this invention pursuant to NASA Contract Number NAS3-25819 (NAS SBIR Phase II) awarded by the U.S. National Aeronautics and Space Administration.

TECHNICAL FIELD

This disclosure is concerned with a common heat transfer head for a two cylinder opposed Stirling cycle machine.

BACKGROUND OF THE INVENTION

Stirling cycle machines, whether in the form of engines (driven by an external heat source) or heat pumps (driven by an external source of mechanical power), typically utilize three forms of heat exchangers associated with an oscillating displacer. The displacer reciprocates between an expansion space and a compression space within an enclosing cylinder in a Stirling cycle mode of operation.

The three "heat exchangers" are typically termed a "heat acceptor" or heater, a "heat rejector" or cooler and a "regenerator". The general design of these elements is well-known in this technological field. It is summarized in U.S. Pat. No. 4,671,064, issued June 9, 1987 to Maurice A. White and Stuart G. Emigh, which is hereby incorporated into the present disclosure by reference.

The present invention arose from a desire to simplify the machine structure and to improve the operational efficiency of two cylinder opposed Stirling cycle machines by reducing the resistance to flow and/or increasing heat transfer of working gas between the expansion and compression spaces. This is accomplished by interposing a common heat acceptor between the coaxially aligned movable displacers. Among the design criteria for such a heater head are high heat transfer efficiency, reduced fluid flow resistance, ability to operate under conditions of high temperature and pressure, and low cost of construction.

To minimize the physical volume of such machines, annular regenerators and heat exchangers are often arranged about the exterior cylinder walls. However, the heat acceptor, within which substantial quantities of heat must be exchanged with an external source, usually requires inclusion of elongated tubes or other heat transfer passages in which the working fluid of the machine must effect a complete reversal of direction—a 180° bend in the fluid path. This is illustrated schematically in FIG. 1.

FIG. 1 schematically shows a Stirling cycle machine having an oscillating displacer 11 contained within a surrounding cylinder 10. A conventional clearance seal 12 is illustrated between cylinder 10 and displacer 11 to separate working fluid (typically a gas) in the expansion space 13 and compression space 14 at the respective ends of cylinder 10.

The three heat exchangers associated with the working fluid are shown as a heat acceptor 15, a heat rejector 17 and an annular regenerator 19. They are arranged between the expansion space 13 and compression space 14 in the conventional order associated with Stirling machines.

The prior art heat acceptors 15 (FIG. 1) typically include a heat supply connection shown at 16. The heat supply connection 16 is operably connected to an external heat source (not shown). In the case of a Stirling engine, the heat source might be a source of combustion, solar energy, radioisotope, etc. In the case of a Stirling heat pump, the heat source might be a building, electronic equipment, or other external equipment (not shown) that requires heat removal. In the schematically illustrated device, heated gas or vapor is directed into the heat acceptor 15 through a conduit 16, as shown by arrow A, and condensed liquid will be returned along the walls of conduit 16, as shown by arrows B. The heat rejector 17 is provided with heat sink connections 18 through which fluid (gas or liquid) flows to carry heat from the machine, as shown by arrows C.

It is typical in Stirling cycle machines to direct working fluid through the various heat exchangers between the expansion space and compression space of each cylinder. In some two cylinder opposed Stirling cycle machines, there has been proposed branching of working gas from a common plenum or expansion space between the two displacers. However, this requires separate flow paths through two heaters, whether arranged annularly about the coaxial cylinders or in a parallel fluid path alongside them. The open plenum typically presents a relatively large volume of working fluid that is non-processed between the two opposed displacers. It is essentially "dead volume" that does not contribute to operational efficiency in the machine.

The current invention streamlines the flow of working fluid through a common heat transfer head, providing two elongated fluid paths in the heat transfer head for effective heat transfer from a common heat source. It eliminates the 180° fluid path bend and reversal of fluid direction that have been associated with prior heat transfer heads at one axial end of a cylinder in a Stirling cycle machine. It does this by providing cross flow of working fluid between the expansion space of each coaxially aligned cylinder and the compression space of the other. Further details will be discussed with respect to the specific physical embodiment of the invention illustrated in the accompanying drawings.

BRIEF DESCRIPTION OF THE DRAWINGS

The preferred embodiment of the invention is illustrated in the accompanying drawings, in which:

FIG. 4 is a top view of the heat transfer head;

FIG. 8 is a modified presentation of FIG. 6.

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

Figure 1:
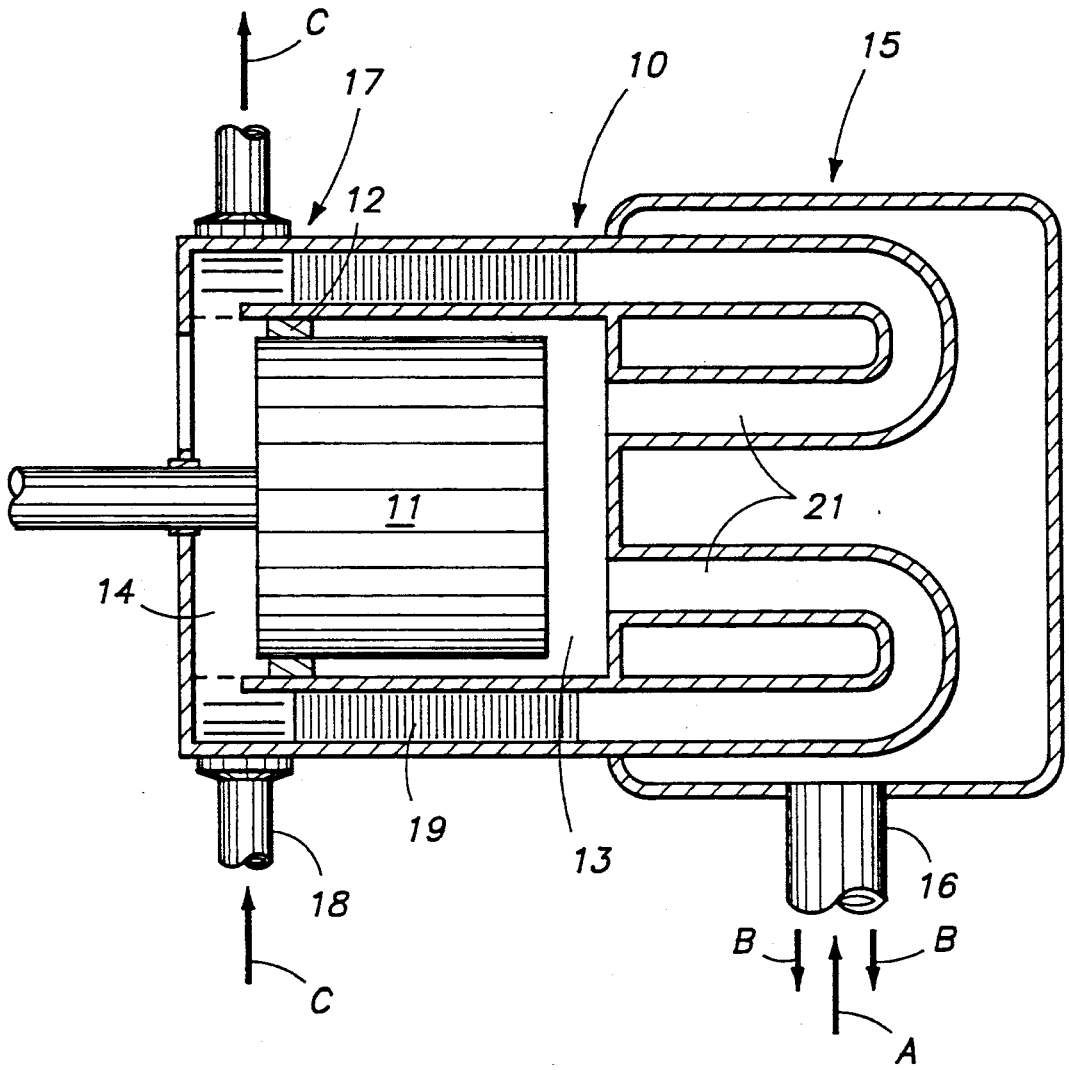
FIG 1 PRIOR ART
FIG. 1 is a diagrammatic illustration of a prior art Stirling cycle machine.
Figure 2:
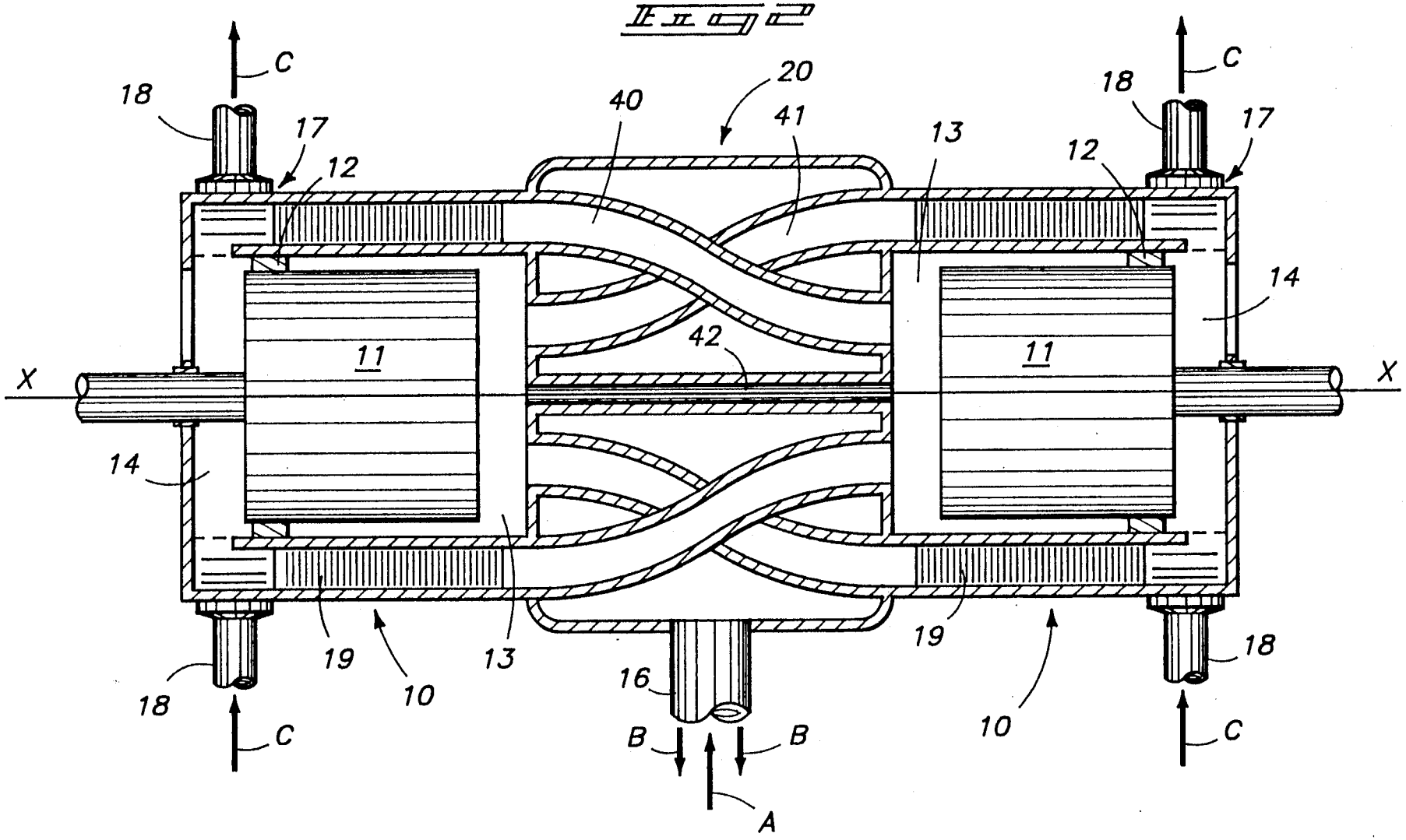
FIG. 2 is a similar diagrammatic view showing the present invention.

The general features of the present improvement are illustrated schematically with respect to a Stirling cycle machine (engine or heat pump) as shown in FIG. 2. The elements of the illustrated two cylinder opposed Stirling cycle machine generally corresponding to components of the prior art illustration in FIG. 1 are identified by reference numerals identical to those previously described with respect to FIG. 1.

FIG. 2 illustrates addition of a second opposed displacer 11 contained within a second cylinder 10. The two displacers 11 are movably mounted along a common axis X—X within the respective cylinders 10 for equal and opposite oscillating movement relative to one another between an expansion space 13 at a first end of each cylinder and a compression space 14 at its remaining end.

A common heat transfer head 20 is positioned between the two cylinders 10, replacing the individual heat acceptor 15 of FIG. 1. Two sets of cross flow heater tubes 40 and 41 replace the previously-described U-shaped heater tubes 21. Tubes 40, 41 serve as "duct means" in separate fluid communication with the respective expansion spaces 13 of the two cylinders 10 for confining the movement of working fluid in two fluid paths that respectively extend between the expansion space 13 of one cylinder 10 and the compression space 14 of the other.

The tubes 40, 41 are located within the common heat transfer head 20, which is located adjacent to the inner ends of the cylinders 10. By extending tubes 40, 41 through the common heat transfer head 20, heat transfer is effected with respect to the moving working fluid of both cylinders.

The working fluid path shown in FIG. 2 extends from the expansion space 13 of one cylinder 10 to the compression space 14 of the other. It includes the annular regenerator 19 and the heat rejector 17 associated with the other cylinder. A Stirling cycle machine designed as schematically shown in FIG. 2 maintains the coaxial alignment of the opposed displacers 11, but directs working fluid from each expansion space 13 through heat transfer head 20 without reversing the direction of flow of the working fluid. Such reversal would be necessary in order to direct working fluid between the expansion space of each cylinder and the compression space of the same cylinder through a regenerator, heat rejector, and a common axially aligned heat exchanger shared by two cylinders.

The schematic presentation of FIG. 2 also shows a pressure equalizer passage 42 leading between the two expansion spaces 13 to assure that working fluid pressures remain equal in the two cylinders.

The method of operating a two cylinder opposed Stirling cycle machine, as illustrated schematically by FIG. 2, basically comprises the alternating steps of (1) directing working fluid from the expansion space of each cylinder through the heat accepter, regenerator and heat rejector in a fluid path leading to the compression space of the other cylinder and (2) directing working fluid from the compression space of each cylinder through the heat accepter, regenerator and heat rejector in a fluid path leading to the expansion space of the other cylinder. More specifically, the method further comprises the step of directing the working fluid through a common heat acceptor during both steps.

A specific embodiment of a heat transfer head 20 incorporating the above-described apparatus and method is detailed in FIGS. 3–6. It is designed to be interposed between two opposed cylinders of a Stirling cycle machine. Since the remaining elements of these machines are well known and readily understandable to those skilled in this field, only the heat transfer head itself is illustrated in detail beyond the general description of the Stirling cycle machines illustrated by FIG. 2.

Figure 3:
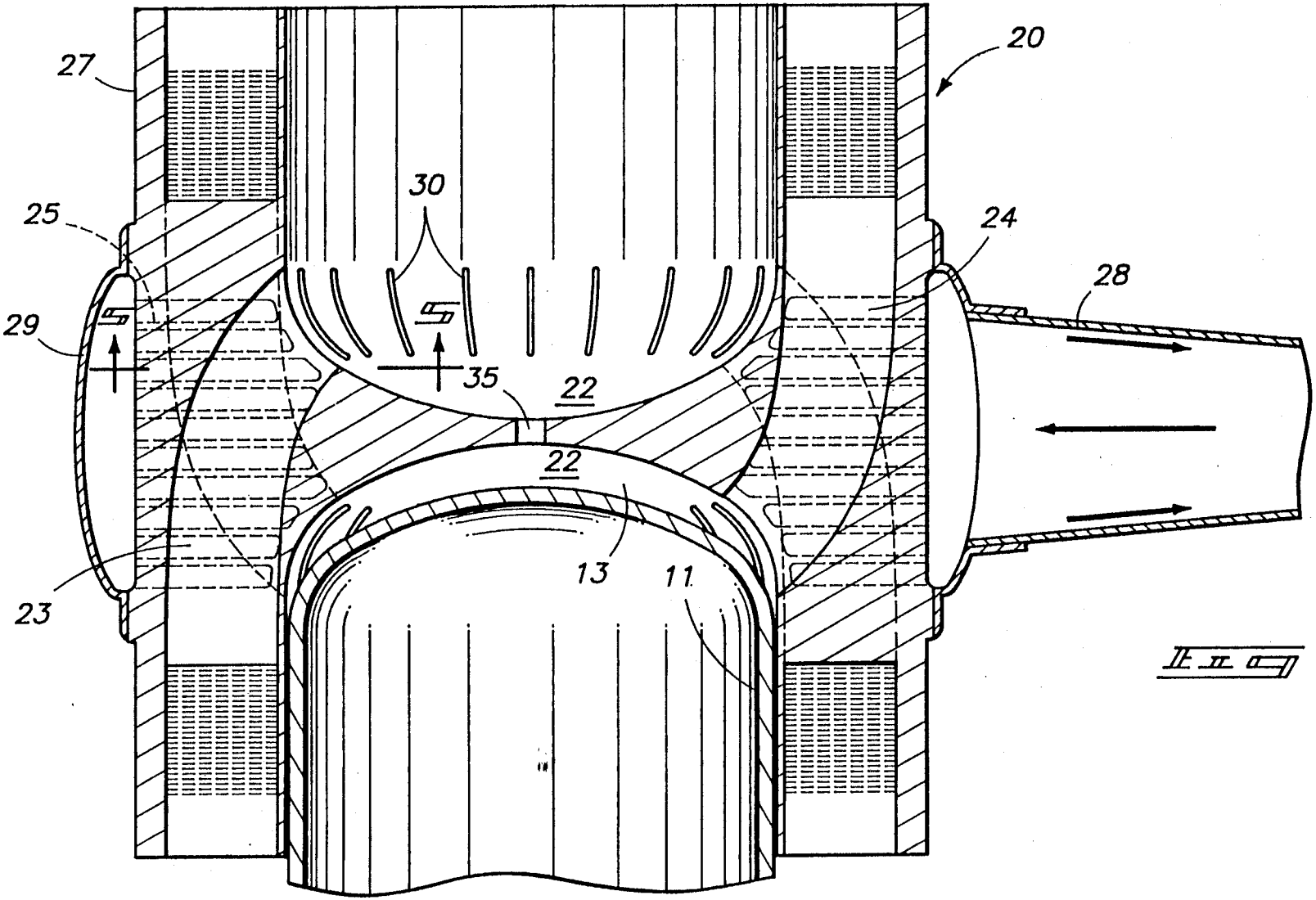
FIG. 3 is a transverse sectional view through the heat transfer head, the right hand portion of the view being taken through a channel leading to the expansion space of one of cylinder and the left hand portion being taken through a channel leading to the expansion space of the other.
Figure 11:
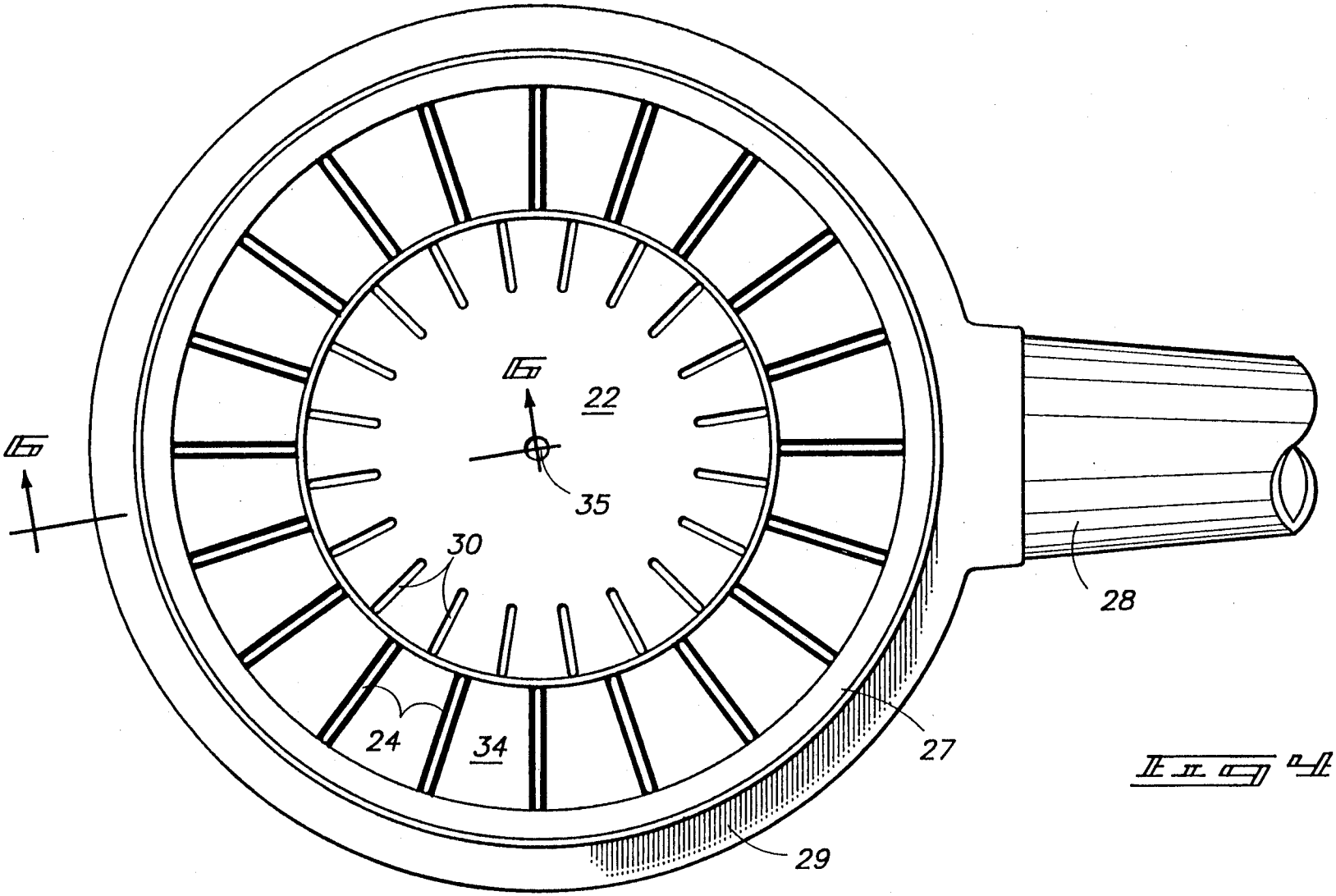
Figure 5:
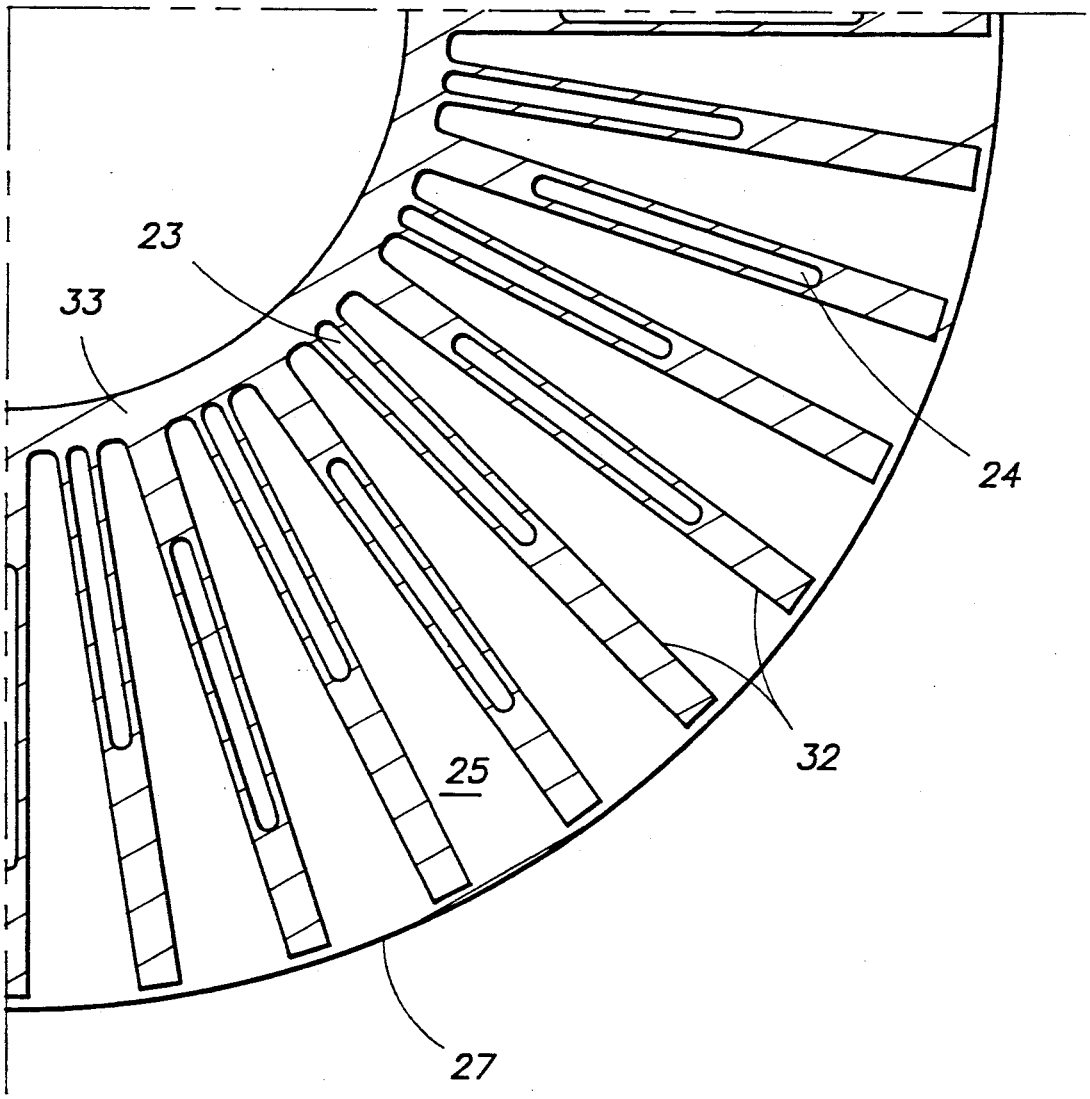
FIG. 5 is an enlarged fragmentary sectional view taken along line 5—5 in FIG. 3.
Figure 6:
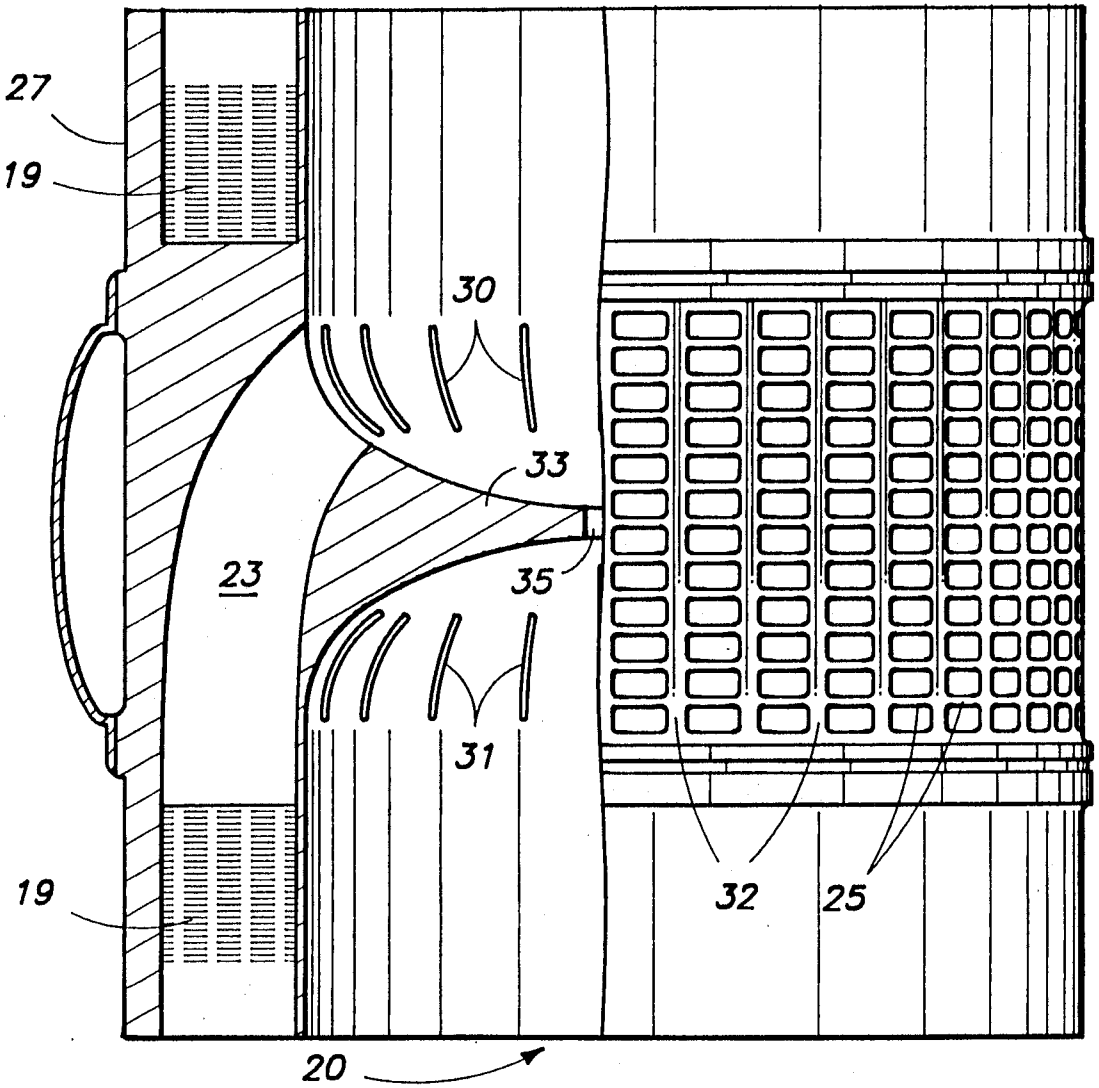
FIG. 6 is a side elevation view showing the exterior of the heat transfer head at the right, the left hand side of the view being a sectional view taken along line 6—6 in FIG. 4.

Heat transfer head 20 is in the form of a cylindrical casting having a substantially cylindrical outer surface 27. The heat transfer head 20 is adapted to be coaxially positioned between coaxially aligned cylinders for the two displacers 11. It includes inwardly-recessed axial ends leading to transverse curved surfaces 22 adapted to serve as the inner ends of the opposing cylinders. The bottom portion of FIG. 3 illustrates a typical spatial relationship between the inner end of each displacer 11 and the adjacent transverse surface 22 formed across heat transfer head 20.

The central section of heat transfer head 20 is surrounded by heat supply means, shown as a heat delivery tube 28 and a circumferential manifold 29. The heat delivery tube 28 can be operably connected to an external source of heat (not shown) and an external collector for condensed liquid (not shown).

Discharge of condensed liquid can be effected by provision of wicking (not shown) arranged about the exposed surfaces of heat transfer head 20 within the manifold 29 and about the interior surfaces of manifold 29 and heat delivery tube 28 themselves. The use of wicking for this purpose is not in itself new and is a technology understandable to those skilled in related condenser applications. Wicking is particularly useful in applications where gravity flow of liquid cannot be assured. Gravitational systems for collecting the condensed liquid can be substituted where applicable.

The previously-described "duct means" is presented within heat transfer head 20 by two sets of open channels 23, 24. As mentioned above, tubes can be used as the duct means, as well as other forms of open ducts or channels for confining the oscillating working fluid. The illustrated channels 23 and 24 are radially elongated, which provides improved fluid flow and heat transfer capability by presenting a larger interior flow and surface area within a smaller number of openings than is practical in more conventional heat exchangers employing circular or square tube openings for fluid flow.

The two sets of channels 23, 24 are circumferentially arranged about the axis of the housing in an alternating interleaved axial pattern. Channels 23 intersect the transverse surface 22 of a first cylinder 10 at elongated apertures 30. Channels 24 similarly intersect the transverse surface 22 of the remaining cylinder at apertures 31.

Both sets of channels 23, 24 lead in generally axial directions to annular spaces at the respective ends of the housing within which are located separate regenerators 19. The annular openings formed about each end of the housing outwardly of the regenerators 19 are adapted to lead to a heat rejector or heat sink associated with the cylinder axially overlapped by that portion of the housing.

Channels 23 and 24 are formed within integral thin walled radial ribs 32 within the cast housing. Each rib 32 extends radially outward from a solid core 33 formed between the transverse surfaces 22.

The thin-walled, high heat transfer, radial ribs 32 are joined to one another by a plurality of axially spaced, circumferential rings 25. The exterior surfaces of ribs 32 and rings 25 serve as heat transfer surfaces for accepting heat supplied through the heat delivery tube 28 and manifold 29. The ribs 32 are thin-walled to efficiently transfer heat to the working fluid flowing within channels 23 and 24. Rings 25 are spacers that join adjacent pairs of ribs 32 for structural reinforcement. They prevent outward expansion of the thin rib surfaces in response to the elevated pressures to which they are subjected by passage of pressurized working fluid through the channels 23 and 24.

The ribs 32 extend axially between the transverse cylinder surfaces 22 and a pair of transverse apertured annular walls 34 at the opposite axial ends of the housing. Walls 34 that create a transition between the heat acceptor 15 and the regenerators 19.

The outer radial ends of the ribs 32 lie along a continuation of the cylindrical exterior boundary of the cast housing. Channels 23 and 24 are smoothly curved transitions from the apertures 30 and 31, formed circumferentailly about the curved transverse surfaces 22, to the radially enlarged annular cross-section of each regnerator 19. This smoothly curved transition facilitates flow of working fluid back and forth from the expansion space 13 with minimal frictional and dynamic fluid energy losses.

An open aperture 35 is shown through the center of the heat transfer head 20 for maintaining a dynamic pressure balance of the working fluid across the two expansion spaces 13 of the opposed cylinders. Core 33 eliminates the inclusion of an open plenum between the opposed displacers 11.

Figure 7:
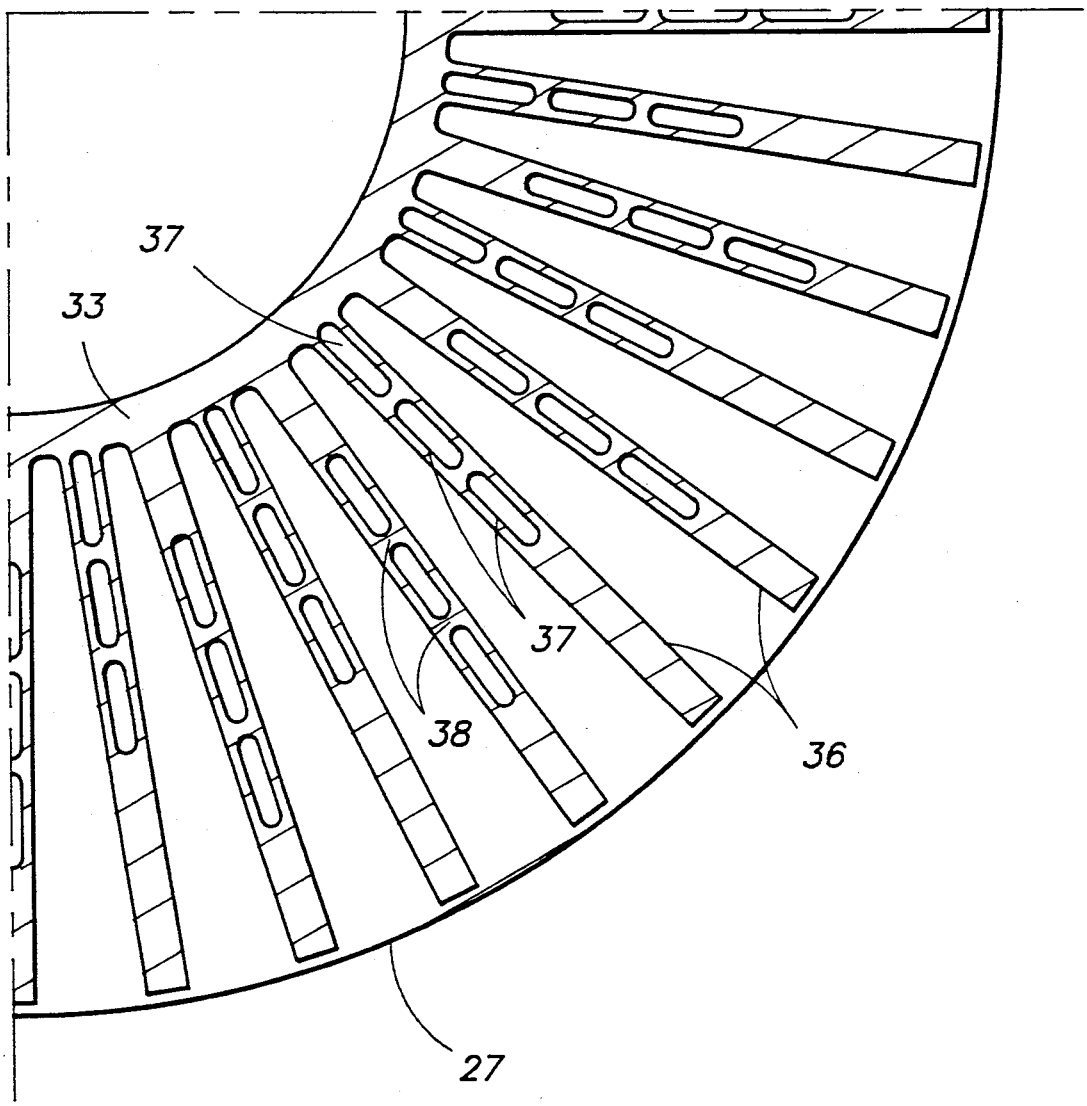
FIG. 7 is a modified presentation of FIG. 5.
Figure 11:
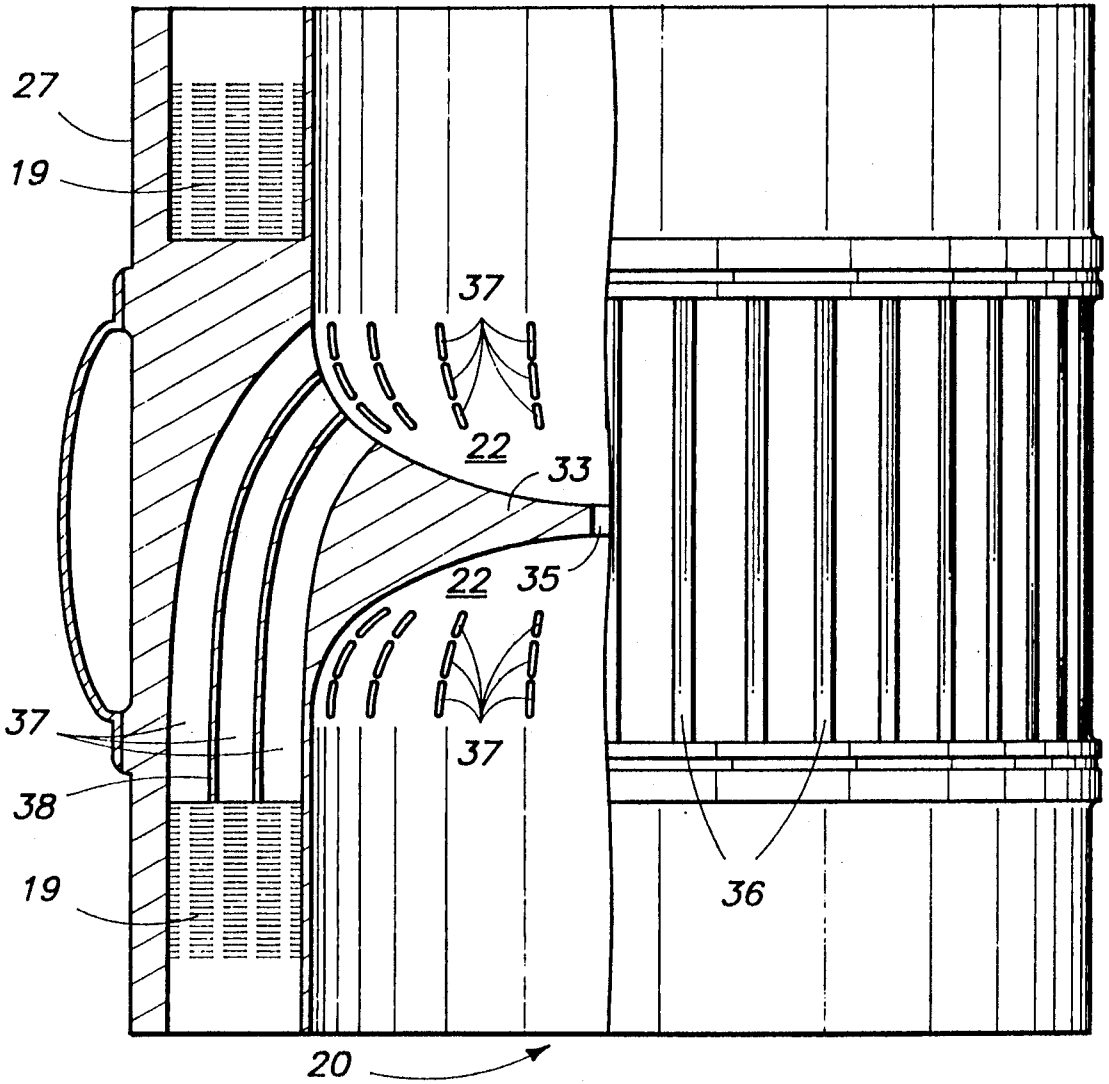

While a single channel 23 or 24 is shown within each rib 32, it is to be understood that multiple channels or openings can lead through each rib, depending upon the structural and heat transfer design requirements of a specific application. One example of this variation is illustrated in FIGS. 7 and 8. Modified ribs 36 are illustrated in these drawings, each having a plurality of channels 37 extending through them in the manner previously described. Each set of channels 37 includes a plurality of openings or channels 37 formed within individual ribs 36 and separated from one another by interconnecting interior rib sections 38.

By using a plurality of such axial channels 37, one can internally reinforce the ribs 36 by the interconnecting sections 38 of each rib that separate the channels 37 formed through it. This makes it practical to eliminate the previously-described rings 25, providing open and unimpeded fluid access to the exterior surfaces of the ribs 36 for more effective heat transfer (see the right-hand portion of FIG. 8.).

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

What is claimed:

1. A two cylinder opposed Stirling cycle machine, comprising:

a pair of coaxially aligned cylinders;

a pair of displacers, the displacers being movably supported along a common axis within the respective cylinders for equal and opposite reciprocating motion with respect to one another between an expansion space at an inner end of each cylinder and a compression space at its outer end in a Stirling cycle mode of operation;

a common heat acceptor located adjacent to the inner ends of the cylinders; and duct means in separate fluid communication with the respective expansion spaces of the two cylinders for confining the movement of working fluid in two fluid paths that respectively extend between the expansion space of one cylinder and the compression space of the other and through the common heat acceptor for effecting heat transfer between moving working fluid and the heat acceptor;

the duct means comprising:

two sets of channels formed within radial ribs circumferentially arranged in angularly spaced locations about the common axis of the cylinders in an alternating interleaved axial pattern communicating respectively with the expansion space of one cylinder or the other.

2. The Stirling cycle machine of claim 1, wherein:

each set of channels includes a plurality of openings formed within individual ribs and separated from one another by interconnecting interior rib sections.

3. A two cylinder opposed Stirling cycle machine, comprising:

a pair of coaxially aligned cylinders;

a pair of displacers, the displacers being movably supported along a common axis within the respective cylinders for equal and opposite reciprocating motion with respect to one another between an expansion space at an inner end of each cylinder and a compression space at its outer end in a Stirling cycle mode of operation;

a common heat acceptor located adjacent to the inner ends of the cylinders; and duct means in separate fluid communication with the respective expansion spaces of the two cylinders for confining the movement of working fluid in two fluid paths that respectively extend between the expansion space of one cylinder and the compression space of the other and through the common heat acceptor for effecting heat transfer between moving working fluid and the heat acceptor;

the duct means comprising:

two sets of radially-elongated channels formed within thin-walled ribs circumferentially arranged in angularly spaced locations about the common axis of the cylinders in an alternating interleaved axial pattern communicating respectively with the expansion space of one cylinder or the other; and a plurality of axially spaced, circumferential rings joining adjacent ribs as structural reinforcement.

4. A heat transfer head for a two cylinder opposed Stirling cycle machine including a pair of coaxially aligned cylinders that respectively contain individual displacers for equal and opposite reciprocating motion with respect to one another between an expansion space at an inner end of each cylinder and a compression space at its outer end in a Stirling cycle mode of operation; the heat transfer head comprising:

a housing centered about a reference axis, the housing being adapted to be coaxially positioned between the cylinders;

heat supply means on the housing adapted to receive heat from an external heat source; and duct means within the housing, the duct means extending through the heat acceptor means for effecting heat transfer between moving working fluid and the heat acceptor means and for establishing separate fluid communication with the respective expansion spaces of the two cylinders to confine movement of working fluid in two fluid paths that respectively extend between the expansion space of one cylinder and the compression space of the other;

the duct means comprising:

two sets of channels formed within thin-walled radial ribs circumferentially arranged in angularly spaced locations about the reference axis in an alternating interleaved axial pattern adapted to communicate respectively with the expansion space of one cylinder or the other.

5. The heat transfer head of claim 4, wherein the duct means further comprises:

each set of channels including a plurality of openings formed within individual ribs and separated from one another by interconnecting interior rib sections.

6. The heat transfer head of claim 4, wherein the duct means further comprises:

a plurality of axially spaced, circumferential rings joining adjacent ribs as structural reinforcement.

7. A heat transfer head for a two cylinder opposed Stirling cycle machine including a pair of coaxially aligned cylinders that respectively contain individual displacers for equal and opposite reciprocating motion with respect to one another between an expansion space at an inner end of each cylinder and a compression space at its outer end in a Stirling cycle mode of operation; the heat transfer head comprising:

a cylindrical housing centered about a reference axis, the housing being adapted to be coaxially positioned between the cylinders and including inwardly-recessed axial ends leading to transverse surfaces adapted to serve as the inner ends of the opposing cylinders of a Stirling cycle machine;

heat supply means on the housing adapted to receive heat from an external heat source;

duct means within the housing, the duct means extending through the transverse surfaces and the heat acceptor means for effecting heat transfer between oscillating working fluid and the heat acceptor means and for establishing separate fluid communication with the respective expansion spaces of the two cylinders along two fluid paths that respectively extend outwardly through the housing in opposite directions substantially parallel to the reference axis;

the duct means comprising:

two sets of channels formed within integral thin-walled radial ribs within the housing, the ribs being circumferentially arranged in angularly spaced locations about the reference axis in an alternating interleaved axial pattern with the channels therein leading respectively to the two transverse surfaces.

8. The heat transfer head of claim 7, wherein:

each set of channels includes a plurality of openings formed within individual ribs and separated from one another by interconnecting interior rib sections.

9. The heat transfer head of claim 7, wherein the duct means further comprises:

a plurality of axially spaced, circumferential integral rings within the housing, the rings joining adjacent ribs as structural reinforcement.

* * * * *